US008680400B2

(12) United States Patent
Hermes

(10) Patent No.: US 8,680,400 B2
(45) Date of Patent: Mar. 25, 2014

(54) VISUAL CABLE IDENTIFICATION

(75) Inventor: Robert Charles Hermes, San Francisco, CA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 455 days.

(21) Appl. No.: 12/619,891

(22) Filed: Nov. 17, 2009

(65) Prior Publication Data

US 2011/0114360 A1 May 19, 2011

(51) Int. Cl.
*H01B 7/00* (2006.01)

(52) U.S. Cl.
USPC ..... 174/110 R; 174/112

(58) Field of Classification Search
USPC ..... 174/110 R, 113 R, 110 SR, 110 PM, 112
See application file for complete search history.

(56) References Cited

U.S. PATENT DOCUMENTS

| | | | | | |
|---|---|---|---|---|---|
| 3,069,579 | A * | 12/1962 | Berg et al. | 313/511 |
| 3,819,973 | A * | 6/1974 | Hosford | 313/498 |
| 5,468,914 | A * | 11/1995 | Falciglia et al. | 174/112 |
| 5,485,355 | A * | 1/1996 | Voskoboinik et al. | 362/84 |
| 5,753,381 | A * | 5/1998 | Feldman et al. | 428/696 |
| 5,869,930 | A * | 2/1999 | Baumberg et al. | 313/506 |
| 5,876,863 | A * | 3/1999 | Feldman et al. | 428/690 |
| 5,922,996 | A * | 7/1999 | Ryeczek | 174/112 |
| 6,957,001 | B2 * | 10/2005 | He | 385/104 |
| 6,960,725 | B2 * | 11/2005 | Zhengkai et al. | 174/102 R |
| 7,401,961 | B2 * | 7/2008 | Longatti et al. | 362/551 |
| 7,406,231 | B1 * | 7/2008 | Beck et al. | 385/100 |
| 2006/0046580 | A1 | 3/2006 | Ankerstjerne | |
| 2006/0254803 | A1 | 11/2006 | Dorffler et al. | |
| 2008/0277135 | A1 * | 11/2008 | Yin | 174/108 |

* cited by examiner

*Primary Examiner* — William H Mayo, III
(74) *Attorney, Agent, or Firm* — Greenblum & Bernstein, P.L.C.

(57) ABSTRACT

A cable is made visually identifiable. The visually identifiable cable includes an electrically illuminable outer sheathing. At least one internal tangible transmission interface medium is internally disposed in the electrically illuminable outer sheathing.

18 Claims, 5 Drawing Sheets

VISUAL CABLE IDENTIFICATION

BACKGROUND

1. Field of the Disclosure

The present disclosure relates to the field of electronic equipment. More particularly, the present disclosure relates to electronic equipment that can be made selectively identifiable visually.

2. Background Information

At times, cables are placed in environments in which the cables are difficult to distinguish. For example, multiple similar cables may be placed in the same environment. In such an environment, individual cables may be distinguished by affixing static labels to cable ends. Similarly, drawings may be provided in which individual cables are distinguished by showing one or more cable route(s) with reference to individual support points along the route(s).

DETAILED DESCRIPTION

In view of the foregoing, the present disclosure, through one or more of its various aspects, embodiments and/or specific features or sub-components, is thus intended to bring out one or more of the advantages as specifically noted below.

Figure 1:
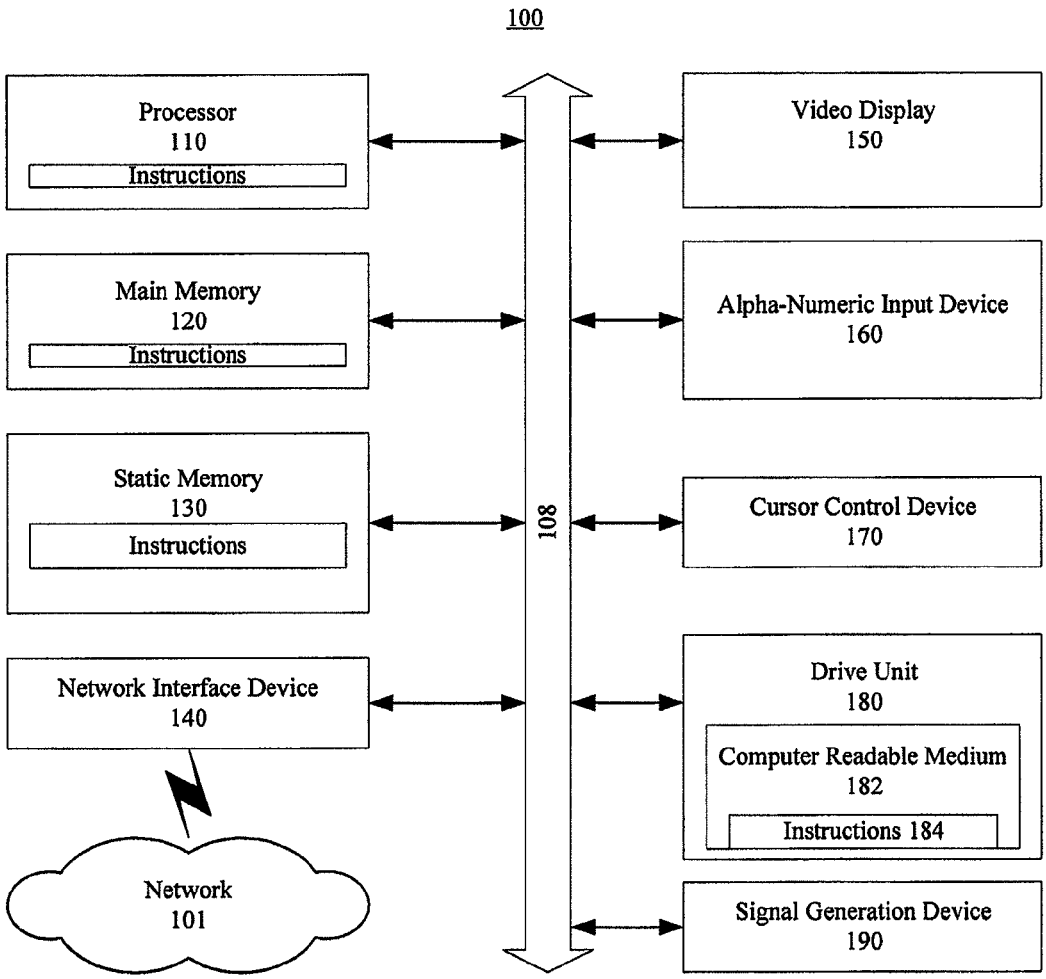
FIG. 1 shows an exemplary general computer system that includes a set of instructions for controlling the visual cable identification described herein.

FIG. 1 is an illustrative embodiment of a general computer system that includes a set of instructions for controlling the visual cable identification described herein. The general computer system is shown and is designated 100. The computer system 100 can include a set of instructions that can be executed to cause the computer system 100 to perform any one or more of the methods or computer based functions disclosed herein. The computer system 100 may operate as a standalone device or may be connected, for example, using a network 126, to other computer systems or peripheral devices.

In a networked deployment, the computer system may operate in the capacity of a server or as a client user computer in a server-client user network environment, or as a peer computer system in a peer-to-peer (or distributed) network environment. The computer system 100 can also be implemented as or incorporated into various devices, such as a personal computer (PC), a tablet PC, a set-top box (STB), a personal digital assistant (PDA), a mobile device, a global positioning satellite (GPS) device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single computer system 100 is illustrated, the term "system" shall also be taken to include any collection of systems or sub-systems that individually or jointly execute a set, or multiple sets, of instructions to perform one or more computer functions.

As illustrated in FIG. 1, the computer system 100 may include a processor 102, for example, a central processing unit (CPU), a graphics processing unit (GPU), or both. Moreover, the computer system 100 can include a main memory 104 and a static memory 106 that can communicate with each other via a bus 108. As shown, the computer system 100 may further include a video display unit 110, such as a liquid crystal display (LCD), an organic light emitting diode (OLED), a flat panel display, a solid state display, or a cathode ray tube (CRT). Additionally, the computer system 100 may include an input device 112, such as a keyboard, and a cursor control device 114, such as a mouse. The computer system 100 can also include a disk drive unit 116, a signal generation device 118, such as a speaker or remote control, and a network interface device 120.

In a particular embodiment, as depicted in FIG. 1, the disk drive unit 116 may include a computer-readable medium 122 in which one or more sets of instructions 124, e.g. software, can be embedded. A computer-readable medium 122 is a tangible article of manufacture, from which sets of instructions 124 can be read. Further, the instructions 124 may embody one or more of the methods or logic as described herein. In a particular embodiment, the instructions 124 may reside completely, or at least partially, within the main memory 104, the static memory 106, and/or within the processor 102 during execution by the computer system 100. The main memory 104 and the processor 102 also may include computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

The present disclosure contemplates a computer-readable medium 122 that includes instructions 124 or receives and executes instructions 124 responsive to a propagated signal, so that a device connected to a network 126 can communicate voice, video or data over the network 126. Further, the instructions 124 may be transmitted or received over the network 101 via the network interface device 120.

Figure 2:
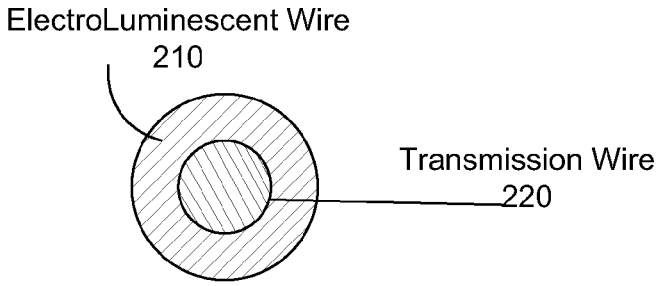
FIG. 2 shows a cross-sectional view of an exemplary visually identifiable cable, according to an aspect of the present disclosure.

FIG. 2 shows a cross-sectional view of an exemplary visually identifiable cable. As shown, the visually identifiable cable includes an electrically illuminable outer sheathing and an internal tangible transmission interface medium internally disposed in the electrically illuminable outer sheathing. In the embodiment of FIG. 2, the internal tangible transmission interface medium is a transmission wire 220, and the electrically illuminable outer sheathing is an electroluminescent wire 210. Electroluminescent wire is generally recognized as a copper wire coated in phosphor. Electroluminescent wire glows when an AC current is applied. A more detailed explanation of electroluminescent wire used in embodiments of the present disclosure is set forth in the description of FIG. 4 below. In the embodiments of the present disclosure, the electroluminescent wire may be provided as a wrap of layers used to produce the electroluminescent glow, where the wrap can be wrapped around an ethernet transmission wire. In the embodiments of the present disclosure, the electroluminescent wire may also be provided as a hollow electroluminescent wire in which a hollow passage is surrounded by the layers used to produce the electroluminescent glow. In the embodiment of FIG. 2, the electroluminescent wire 210 is provided around the periphery of the transmission wire 220.

In an embodiment, the electroluminescent wire 210 may be molded around the transmission wire 220 in production, and the resultant combination may then be provided together as an integral visually identifiable cable to end users. In the case where the electroluminescent wire 210 is molded around the transmission wire 220, the electroluminescent wire 210 may be molded to wrap around an arbitrary length of the transmission wire 220 along a segment of the transmission wire 220 selected by the manufacturer.

Alternatively, the electroluminescent wire 210 may be provided separately from the transmission wire 220, and then wrapped around the transmission wire 220 by an end user such as a technician. Once wrapped around the transmission wire 220, two edges of the electroluminescent wire 210 may be secured to each other using mechanisms such as Velcro, hooks, or glue or another sticky subject.

The electroluminescent wire 210 may be provided around the transmission wire 220 for the entirety or substantively the entirety of the transmission wire 220, or for one or more isolated segments of the length of the transmission wire 220. In the case where the electroluminescent wire 210 is provided separately from the transmission wire 220, the electroluminescent wire 210 may be sold as a wrap of a predetermined length to wrap around transmission wire 220 along a segment of the transmission wire 220 selected by a user. The user may selectively wrap the electroluminescent wire 210 around any transmission wire 220 that meets characteristics of the exemplary transmission wire described herein so that the combination results in the visually identifiable cable disclosed herein.

As another alternative, the electroluminescent wire 210 may be physically affixed to the transmission wire 220, rather than molded around or wrapped around the transmission wire 220. In this manner, the electroluminescent wire 210 may be molded along a side of the transmission wire 220, along the periphery of the transmission wire 220 at less than the entire circumference of the transmission wire 220. In another embodiment, the electroluminescent wire 210 may be attached to a side of the transmission wire 220 using glue, Velcro, or any other bonding mechanism, along the periphery of the transmission wire 220 at less than the entire circumference of the transmission wire 220. As in the embodiments above, the electroluminescent wire 210 may be attached along an arbitrary or predetermined length of the transmission wire 220 along a segment of the transmission wire 220 selected by a user or the manufacturer.

The transmission wire 220 may be an internal tangible transmission interface medium that complies with the institute of electronics and electrical engineers standard 802.3af for power over ethernet (PoE). As an example of the capabilities of such a compliant transmission interface medium, the transmission wire 220 may carry approximately 48 volts DC at currents up to approximately 400 milli-amperes.

The IEEE 802.3af power over ethernet standard describes a system in which DC power and data are both provided to remote devices over cables in an ethernet network. The IEEE 802.3af standard does not require modification of existing ethernet cabling infrastructure. Some transmission wire may be paired or otherwise bundled to increase the amount of power that can be provided over a cable to one or more remote devices. Examples of the remote devices that may be powered using power over ethernet include communications devices, image-capture devices, image-display devices, music devices, and computing devices. Exemplary communications devices that may be powered using power over ethernet include internet protocol (IP) telephones, wireless local area network (LAN) access points, remote network switches or small ethernet switches.

That is, IEEE 802.3af power over ethernet standard compliant systems pass DC power and data over ethernet mediums to remote devices. The DC power may be consumed by or passed-through the remote devices. The data may be processed by or transferred through the remote devices. The data may be any type of data, analog or digital, that is passed over ethernet mediums. Examples of data passed over cables in the embodiments described herein include video or audio data, image data, internet data, text data, or any other types of digital data that are processed by a tangible computer processor.

Figure 3:
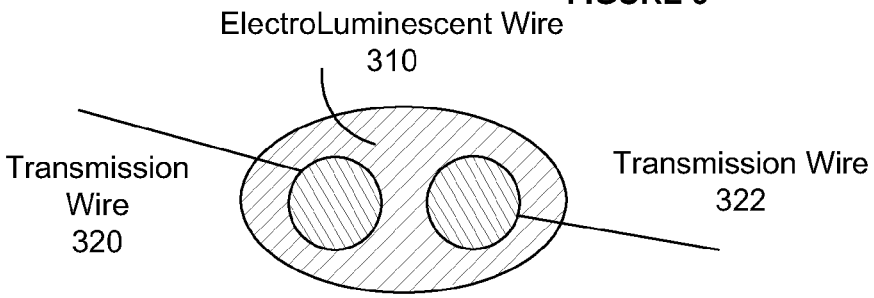
FIG. 3 shows a cross-sectional view of another exemplary visually identifiable cable, according to an aspect of the present disclosure.

FIG. 3 shows a cross-sectional view of another exemplary visually identifiable cable, according to an aspect of the present disclosure. In the embodiment of FIG. 3, transmission wire 320 and transmission wire 322 are each wrapped within a single electroluminescent wire 310. The transmission wires 320 and 322 may be used to separately provide power to a remote device in compliance with the power over ethernet standard, where the use of transmission wires 320 and 322 together results in an increase in the amount of power that can be provided to the remote device powered with the power provided over the transmission wires 320 and 322. As in the embodiment of FIG. 2, the transmission wires 320 and 322 may be wrapped within an electroluminescent wire 310, molded by a manufacturer within the electroluminescent wire 310, or otherwise attached to the electroluminescent wire 310 using glue, Velcro or another attachment mechanism.

Figure 4:
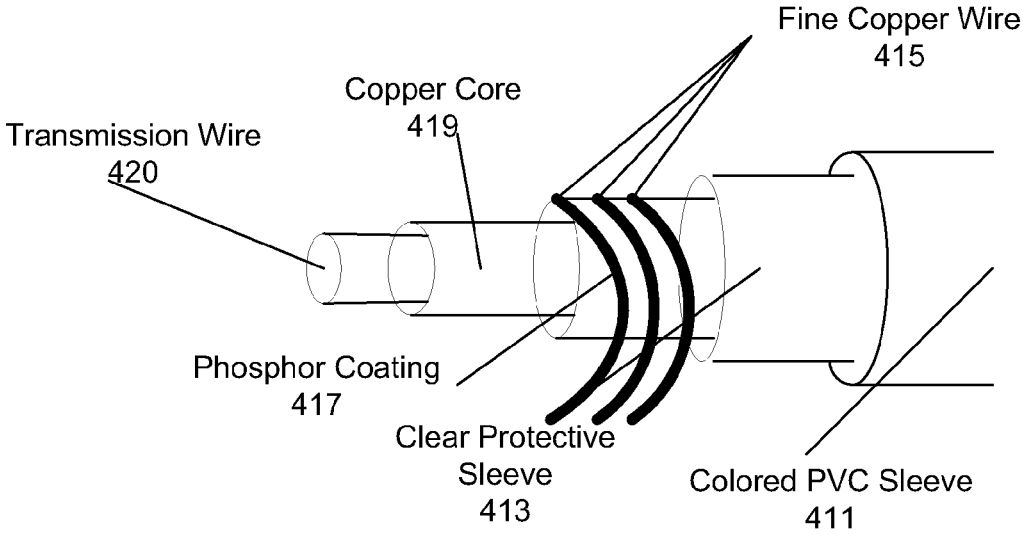
FIG. 4 shows a perspective view of an exemplary visually identifiable cable, according to an aspect of the present disclosure.

FIG. 4 shows an expanded view of an exemplary visually identifiable cable, according to an aspect of the present disclosure. In the embodiment of FIG. 4, the transmission wire 420 is a simple composite cable wire compliant with the IEEE 802.3af power over ethernet standard. However, the electroluminescent wire is shown in an expanded view in comparison with the electroluminescent wires 210, 310 shown in the embodiments previously described. The electroluminescent wire in FIG. 4 includes multiple layers, beginning at the innermost copper core 419 which is provided around the transmission wire 420. A phosphor coating 417 is provided around the copper core 419, and fine copper wire 415 is provided around the phosphor coating 417. A clear protective sleeve 413 is provided around the fine copper wire 415, and a colored polyvinyl chloride (PVC) sleeve 411 is provided around the clear protective sleeve 413.

Visually identifiable cables may be illuminated in different colors by using different colored polyvinyl chloride sleeves. The result of using different colored sleeves allows visually identifiable cables to be selectively distinguished by the illumination itself of the cables, as well as by the difference in colors in which the cables are illuminated. In this way, multiple visually identifiable cables may be distinguished from each other even when present in the same environment and even when more than one are simultaneously illuminated.

As a third way that visually identifiable cables may be made visually identifiable, a source or intermediary via which electricity is applied to the electroluminescent wire may control current such that the illumination of the electroluminescent wire may be selectively turned on and off. As a result of such control, the electroluminescent wire may be made to flash on and off. Therefore, a pattern of on/off flashes may be selectively generated so that the visually identifiable cables illuminate in a pattern controlled by controller of the source or intermediary via which electricity is applied to the electroluminescent wire. An example of a pattern in which on/off flashes may be provided is a series of three flashes, or a series of a long flash followed by a short flash and then another long flash. However, the lengths of flashes and pauses between flashes, as well as the pattern of flashes, may be any lengths or patterns input by a user or controlled by the logic of a physical electronic device.

The illumination of the electroluminescent wire may be controlled remotely. As an example, an on-site technician may be directed to a particular visually identifiable cable when an off-site technician remotely controls a specified power source to provide power to the electroluminescent wire of the particular visually identifiable cable. The particular visually identifiable cable will then be illuminated and identifiable, even when encased or otherwise amidst a bundle of cables. As described herein, the visually identifiable cable may be made visually identifiable as a secondary use or as a primary use of the power provided over power over ethernet cables. That is, the primary use of the power used to illuminate the cable may be consumption by one or more downstream powered devices, so that the secondary use is merely to enable selective illumination of the cables carrying the power. The illumination may then be controlled locally or remotely when controlled over a data network.

In an embodiment, more than one visually identifiable cable may be made distinguishable by two or more of the three mechanisms described above. Thus, a visually identifiable cable may be illuminated in a selective color and in a controlled pattern of flashes. The visually identifiable cable is therefore selectively illuminated by application of electricity to the electroluminescent wire, and the characteristics by which the visually identifiable cables may be identified and distinguished include illumination itself, as well as color of illumination and duration and pattern of illumination.

In accordance with the power over ethernet standard, power is originally supplied through the transmission wire 220, 320, 322 or 420 to a powered device in the embodiments of FIGS. 2, 3 and 4. As explained below, a portion of the power from the internal transmission wires described herein is converted and fed back via one or more devices so that the converted power is applied to the electroluminescent wire so as to illuminate the electroluminescent wire. In other words, DC power may flow one way through the internal transmission wires, whereas AC power converted by one or more devices from the DC power is fed back to the electroluminescent wire wrapped, molded or otherwise attached to the internal transmission wires. Therefore, in the event that the electroluminescent wire serves as an electrically illuminable outer sheathing wrapped around or molded around the transmission wire, the electrically illuminable outer sheathing may be selectively illuminated by application of electricity to the electrically illuminable outer sheathing. The electrically illuminable outer sheathing may be continuously or intermittently illuminated when the electricity is continuously or intermittently applied to the electrically illuminable outer sheathing.

Figure 5:
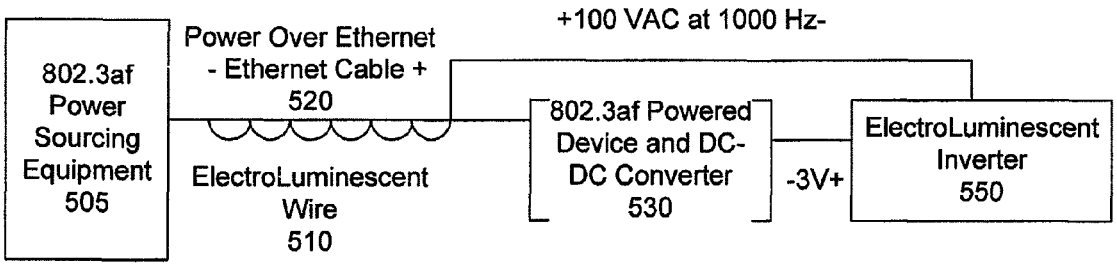
FIG. 5 shows an exemplary system for using a visually identifiable cable, according to an aspect of the present disclosure.

FIG. 5 shows an exemplary system for using a visually identifiable cable, according to an aspect of the present disclosure. In the embodiment of FIG. 5, 802.3af power sourcing equipment 505 supplies power to 802.3af powered device and DC-DC converter 530 via the power over ethernet cable 520. The 802.3af powered device and DC-DC converter 530 supplies a portion of the power received via the power over ethernet cable 520 to an electroluminescent inverter 550, and electroluminescent inverter 550 provides a portion of the power received from the 802.3af powered device and DC-DC converter 530 to electroluminescent wire 510. Thus, power from the 802.3af power sourcing equipment 505 is ultimately fed back to the electroluminescent wire 510 via the power over ethernet cable 520, the 802.3af powered device and DC-DC converter 530, and the electroluminescent inverter 550.

In the embodiment of FIG. 5, the 802.3af powered device provides 3 volts DC to the electroluminescent inverter 550. Remaining power provided to the 802.3af powered device and DC-DC converter 530 by the 802.3af power sourcing equipment 505 may be consumed by the 802.3af powered device and DC-DC converter 530 or, as explained below in the context of other embodiments, fed for use by additional downstream 802.3af powered devices and DC-DC converters 530.

In the embodiment of FIG. 5, the electroluminescent inverter 550 converts the DC voltage provided by the 802.3af powered device and DC-DC converter 530 into AC voltage for the electroluminescent wire 510. In the embodiment of FIG. 5, the electroluminescent inverter 550 provides 100 volts AC at 1000 Hertz to the electroluminescent wire 510. In an embodiment, the application of this current can be controlled by a layer 2 ethernet switch on a port by port basis, and this can be used to identify a particular visually identifiable cable among multiple cables connected to the layer 2 ethernet switch. In such an embodiment, the layer 2 ethernet switch serves as 802.3af power sourcing equipment in a system compliant with the 802.3af power over ethernet standard. As described herein, such a layer 2 ethernet switch may be remotely controlled by a remote off-site control technician to provide power to the particular visually identifiable cable to be identified.

In the embodiment of FIG. 5, the electroluminescent wire 510 may be provided as an electrically illuminable outer sheathing for the power over ethernet cable 520. As such, the electrically illuminable outer sheathing is supplied with current via the electroluminescent inverter to which the electrically illuminable outer sheathing is connected. The electroluminescent inverter is, of course, a tangible physical device and apparatus, as is the 802.3af powered device and DC-DC converter 530 and the 802.3af power sourcing equipment 505.

In the embodiment of FIG. 5, the electroluminescent wire 510 may illuminate in a distinctive color different from a color in which another visually identifiable cable, supplied with current via the electroluminescent inverter 550, illuminates. In this case, the color in which the electroluminescent wire 510 illuminates corresponds to a material used in an outermost layer of the electrically illuminable outer sheathing. As an example, the color in which the electroluminescent wire 510 illuminates may correspond to a color of a colored PVC sleeve such as the colored PVC sleeve 411 shown in the embodiment of FIG. 4. PVC sleeves may be provided in colors such as red, green, yellow, blue, white, or any number of other colors or shades of colors. Different colored PVC sleeves may be used as outermost layers of different electroluminescent wires used as sheaths or attachments for different transmission lines, so that a user can identify the different electroluminescent wires and the underlying or attached transmission lines.

Figure 6:
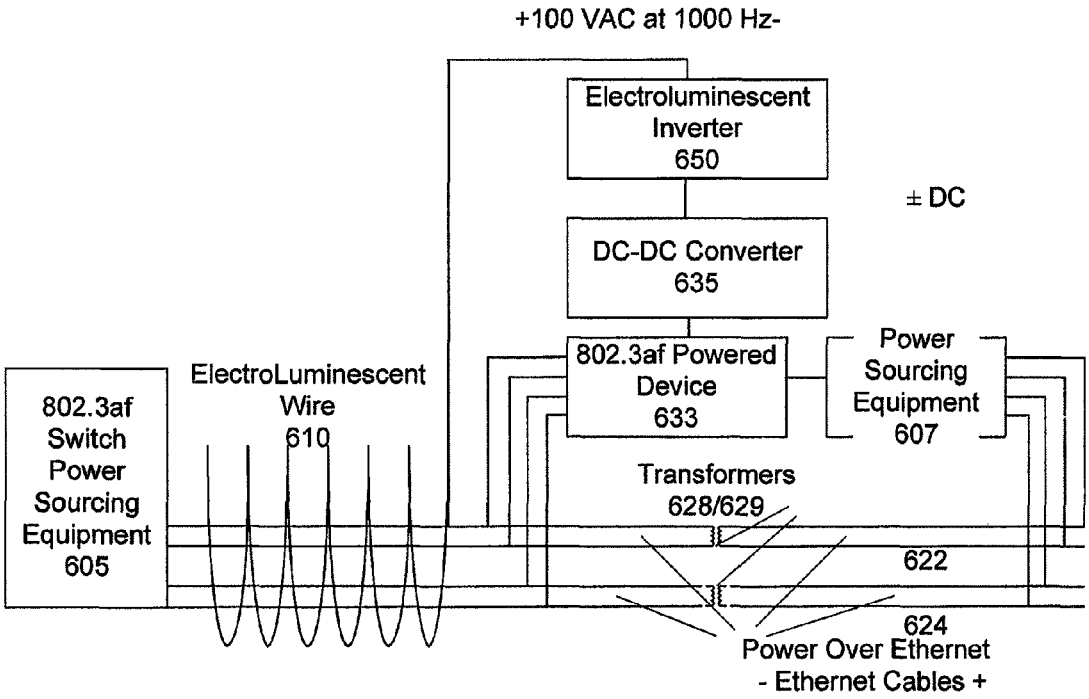
FIG. 6 shows another exemplary system for using a visually identifiable cable, according to an aspect of the present disclosure.

FIG. 6 shows another exemplary system for using a visually identifiable cable, according to an aspect of the present disclosure. In the embodiment of FIG. 6, 802.3af power sourcing equipment 605 supplies power to 802.3af powered device 633, which in turn supplies power to a DC-DC converter 635 that then supplies power to electroluminescent inverter 650. In comparison with the embodiment of FIG. 5, the embodiment of FIG. 6 shows the 802.3af powered device 633 as a separate device from the DC-DC converter 635 rather than as a combined device.

Power sourcing equipment 605 provides power via multiple power over ethernet cables 622, 624. The power provided via the power over ethernet cables 622, 624 may be provided to a single downstream powered device such as 802.3af powered device 633, or to multiple downstream powered devices including 802.3af powered device 633 and another downstream device not shown in FIG. 6. In the embodiment of FIG. 6, it should be apparent that only a portion of the power provided via 802.3af power sourcing equipment 605 is supplied to the 802.3af powered device 633. Indeed, in the embodiment of FIG. 6, power provided to but not consumed by 802.3af powered device 633, DC-DC converter 635, electroluminescent inverter 650 or electroluminescent wire 610, is returned to power over ethernet cables 622, 624 for further downstream consumption via power sourcing equipment 607.

The DC-DC converter 635 supplies a portion of the power received via the power over ethernet cables 622, 624 to an electroluminescent inverter 650, and electroluminescent inverter 650 provides a portion of the power received from the DC-DC converter 635 to electroluminescent wire 610. Thus, power from the 802.3af power sourcing equipment 605 is ultimately fed back to the electroluminescent wire 610 via the power over ethernet cables 622, 624, the 802.3af powered device 633, DC-DC converter 635, and the electroluminescent inverter 650.

In the embodiment of FIG. 6, the DC-DC converter 635 provides DC voltage to the electroluminescent inverter 650. Remaining power provided to the 802.3af powered device 633 and DC-DC converter 635 by the 802.3af power sourcing equipment 605, and not fed for use by electroluminescent wire 610, may be fed for use by additional downstream 802.3af powered devices that are powered via power sourcing equipment 607. The electroluminescent inverter 650 converts the DC voltage provided by the 802.3af powered device 633 and DC-DC converter 635 into AC voltage for the electroluminescent wire 610. In the embodiment of FIG. 6, the electroluminescent inverter 650 provides 100 volts AC at 1000 Hertz to the electroluminescent wire 610.

In the embodiment of FIG. 6, transformers or transformer pairs are shown as gaps in the cables 622, 624. Data passing through cables cannot jump a physical gap in the cable, and a transformer or transformer pair is provided to ensure data connectivity together with DC isolation between source and powered devices. In FIG. 6, transformers 628 and 629 are provided on power over ethernet cables 622 and 624 respectively. Each transformer 628 and 629 is used to isolate DC power that is provided to the 802.3af powered device 633, and then reinsert remaining DC power provided to and recovered from 802.3af powered device 633. In this manner, DC voltage may be provided to and consumed by 802.3af powered device 633, DC-DC converter 635, electroluminescent inverter 650, and electroluminescent wire 610, and the transformers will compensate for the consumed power so as to ensure data and power pass-through downstream on cables 622, 624. The use of transformers 628 and 629 ensures data connectivity along power over ethernet cables 622 and 624. As explained below with respect to the embodiment of FIG. 7, transformers may be used in a manner similar to that shown in FIG. 6 even when only data, and not a particularly significant amount of power, is to be passed through downstream.

In the embodiment of FIG. 6, the electroluminescent wire 610 may be provided as an electrically illuminable outer sheathing for the power over ethernet cables 622, 624. As such, the electrically illuminable outer sheathing is supplied with current via the electroluminescent inverter to which the electrically illuminable outer sheathing is connected. The electroluminescent inverter is, of course, a tangible physical device and apparatus, as is the 802.3af powered device 633 and DC-DC converter 635 and the 802.3af power sourcing equipment 605 and 607.

In the embodiment of FIG. 6, the electroluminescent wire 610 may illuminate in a distinctive color different from a color in which another visually identifiable cable, supplied with current via the electroluminescent inverter 650, illuminates. In this case, the color in which the electroluminescent wire 610 illuminates corresponds to a material used in an outermost layer of the electrically illuminable outer sheathing. As an example, the color in which the electroluminescent wire 610 illuminates may correspond to a color of a colored polyvinyl chloride (PVC) sleeve such as the colored PVC sleeve 411 shown in the embodiment of FIG. 4. Different colored PVC sleeves may be used as outermost layers of different electroluminescent wires used as sheaths or attachments for different transmission lines, so that a user can identify the different electroluminescent wires and the underlying or attached transmission lines.

In the embodiment of FIG. 6, both data and power are supplied by power over ethernet cables 622, 624. Power is partially or fully supplied by these cables 622, 624 for use in powering electroluminescent wire 610 and 802.3af powered device 633. However, the primary use of the ethernet cables 622, 624 is for use in supplying data in an ethernet network, and the power over ethernet 802.3af standard provides for a secondary function of supplying power via such ethernet cables 622, 624. This secondary function of providing power is then used in the present disclosure to provide power to illuminate the electroluminescent wires used as outer sheathing herein. In the embodiment of FIG. 6, the power is used to serially power multiple powered devices, including 802.3af powered device 633 and one or more downstream powered devices (not shown), as well as the electroluminescent wire 610.

Figure 7:
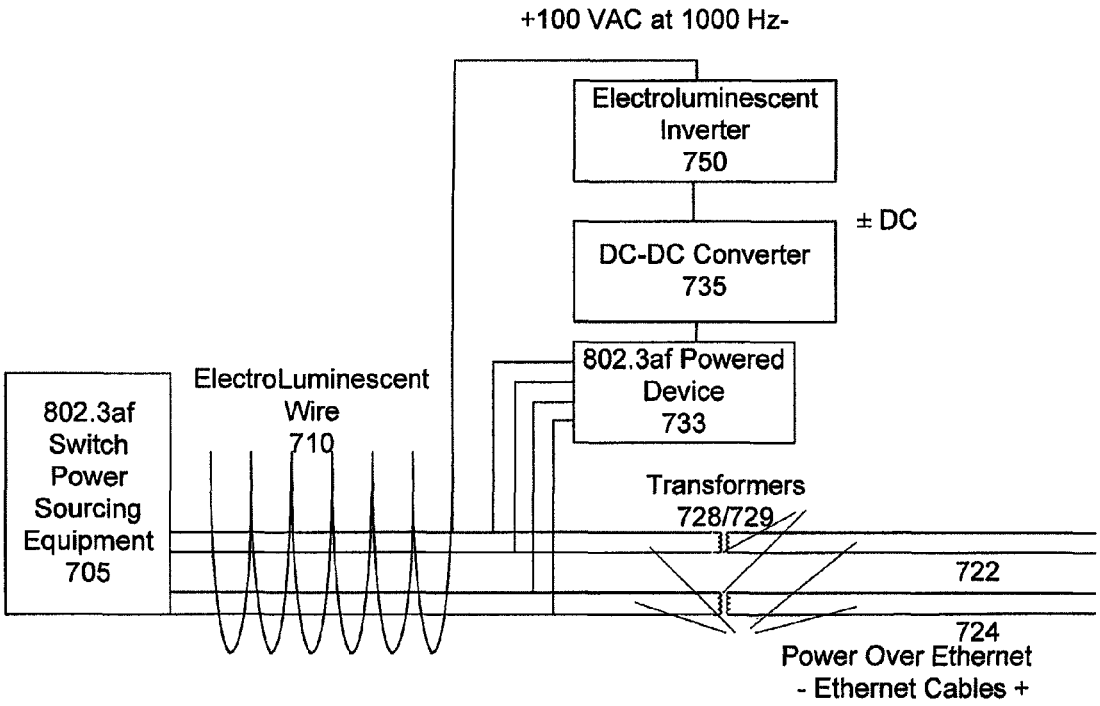
FIG. 7 shows another exemplary system for using a visually identifiable cable, according to an aspect of the present disclosure.

FIG. 7 shows another exemplary system for using a visually identifiable cable, according to an aspect of the present disclosure. In the embodiment of FIG. 7, 802.3af powered device 733 does not provide power back to power over ethernet cables 722, 724 via a secondary power sourcing equipment, in contrast to the embodiment of FIG. 6. This emphasizes that power supplied but not consumed in providing power to electroluminescent wire 710 need not be fed back for downstream use via power over ethernet cables 722, 724. Thus, power over ethernet cables 722, 724 will continue to supply data to downstream devices even if no power is supplied via these cables for consumption in any use other than powering electroluminescent wire 710 and 802.3af powered device 733.

In the embodiment of FIG. 7, 802.3af power sourcing equipment 705 supplies power to 802.3af powered device 733, which in turn supplies power to a DC-DC converter 735 that then supplies power to electroluminescent inverter 750. In comparison with the embodiment of FIG. 5, the embodiment of FIG. 7 also shows the 802.3af powered device 733 as a separate device from the DC-DC converter 735 rather than as a combined device.

Power sourcing equipment 705 provides power via multiple power over ethernet cables 722, 724. The power provided via the power over ethernet cables 722, 724 may be provided to a single downstream powered device such as 802.3af powered device 733, or to multiple downstream powered devices including 802.3af powered device 733 and another downstream device not shown in FIG. 7.

The DC-DC converter 735 supplies power received via the power over ethernet cables 722, 724 to an electroluminescent inverter 750, and electroluminescent inverter 750 provides power received from the DC-DC converter 735 to electroluminescent wire 710. Thus, power from the 802.3af power sourcing equipment 705 is ultimately fed back to the electroluminescent wire 710 via the power over ethernet cables 722, 724, the 802.3af powered device 733, DC-DC converter 735, and the electroluminescent inverter 750.

In the embodiment of FIG. 7, the DC-DC converter 735 provides DC voltage to the electroluminescent inverter 750. The electroluminescent inverter 750 converts the DC voltage provided by the 802.3af powered device 733 and DC-DC converter 735 into AC voltage for the electroluminescent wire 710. In the embodiment of FIG. 7, the electroluminescent inverter 750 provides 700 volts AC at 1000 Hertz to the electroluminescent wire 610.

In the embodiment of FIG. 7, transformers 728 and 729 are provided on power over ethernet cables 722 and 724 respectively. Each transformer 728 and 729 is used to isolate DC power that is provided to the 802.3af powered device 733, and then reinsert remaining DC power provided to and recovered from 802.3af powered device 733.

In the embodiment of FIG. 7, the electroluminescent wire 710 may be provided as an electrically illuminable outer sheathing for the power over ethernet cables 722, 724. As such, the electrically illuminable outer sheathing is supplied with current via the electroluminescent inverter to which the electrically illuminable outer sheathing is connected. The electroluminescent inverter is, of course, a tangible physical device and apparatus, as is the 802.3af powered device 733 and DC-DC converter 735 and the 802.3af power sourcing equipment 705.

In the embodiment of FIG. 7, the electroluminescent wire 710 may illuminate in a distinctive color different from a color in which another visually identifiable cable, supplied with current via the electroluminescent inverter 750, illuminates. In this case, the color in which the electroluminescent wire 710 illuminates corresponds to a material used in an outermost layer of the electrically illuminable outer sheathing. As an example, the color in which the electroluminescent wire 710 illuminates may correspond to a color of a colored PVC sleeve such as the colored PVC sleeve 411 shown in the embodiment of FIG. 4. Different colored PVC sleeves may be used as outermost layers of different electroluminescent wires used as sheaths or attachments for different transmission lines, so that a user can identify the different electroluminescent wires and the underlying or attached transmission lines.

In the embodiment of FIG. 7, both data and power are supplied by power over ethernet cables 722, 724. Power is partially or fully supplied by these cables 722, 724 for use in powering electroluminescent wire 710 and 802.3af powered device 733. However, the primary use of the ethernet cables 622, 624 is for use in supplying data in an ethernet network, and the power over ethernet 802.3af standard provides for a secondary function of supplying power via such ethernet cables 722, 724.

In embodiments above, electrically illuminable outer sheathing may be provided for ethernet cables by electroluminescent wire. The electroluminescent wire illuminates in a color distinguishable from colors in which a plurality of other visually identifiable cables, supplied with current via an electroluminescent inverter device, illuminate. Each of the visually identifiable cables illuminates in a color different from other cables in the environment in which the visually identifiable cables are provided. The distinctive colors are achieved by the different colors of a layer of the electroluminescent wires such as the outer layer of each such electroluminescent wire.

The electroluminescent wires may also illuminate in a distinctive pattern controlled by the electroluminescent inverters or another device to which the electroluminescent wires are attached directly or indirectly. Thus, the electroluminescent wires may be controlled to blink on and off in a distinctive pattern under the control of device. The controlling device may use either pre-programmed digital control data to cause the electroluminescent wires to illuminate in a distinctive pattern, or the controlling device may cause the electroluminescent wires to illuminate under the direct control of a human operator, similar to the manner in which a human physically generates morse code or other types of signals using a device.

In the embodiments above, an inverter converts the DC voltage provided by power over ethernet into AC power required by the electrically illuminable outer sheathing. The inverter may include an electroluminescent inverter connected by the electrically illuminable outer sheathing between a power over ethernet power source device and a power over ethernet powered device. The power over ethernet power source device provides power to the power over ethernet powered device directly over the power over ethernet cables, where the power over ethernet cables are tangible transmission interface medium. The power over ethernet powered device provides DC power to the electroluminescent inverters, the electroluminescent inverters convert the DC power to AC power, and the electroluminescent inverters provides the converted AC power as the AC power required by the electroluminescent outer sheathing. The power over ethernet power source devices may control application of power to one or a plurality of power over ethernet powered devices on an individual basis.

The embodiments of FIGS. 6 and 7 each show that power provided by power over ethernet cables 622, 624 and 722, 724 is transformed by transformers shown in the breaks of each such cable, so as to allow and compensate for the diversion of power to the powered devices and for use by the electroluminescent wires. The DC voltage provided to the inverter in each of the embodiments of FIGS. 6 and 7 is provided from the power provided over the power over ethernet cables 520, 622, 624, 722, 724. Power provided to the inverter and not required by the electroluminescent wire in the embodiment of FIG. 6 is returned to the visually identifiable cable to power downstream power over ethernet devices via a second power over ethernet source device.

Accordingly, the present invention enables visual cable identification in circumstances such as when a cable is otherwise indistinguishable in part or in whole in the environment in which the cable is placed. The illumination may be controlled locally or remotely, so that an on-site technician can identify a cable by selective control of power over a specified cable.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather the invention extends to all functionally equivalent structures, methods, and uses such as are within the scope of the appended claims.

For example, although the description herein references power over ethernet compliant devices and system, the descriptions herein would be applicable to subsequent or equivalent systems for providing power as a secondary feature over internal or attached signal transmission lines. Additionally, the descriptions herein would be applicable to cables which receive power from secondary sources rather than internal or attached signal transmission lines.

While a computer-readable medium herein may be shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. Accordingly, the disclosure is considered to include any computer-readable medium or other equivalents and successor media, in which data or instructions may be stored.

Although the present specification describes components and functions that may be implemented in particular embodiments with reference to particular standards and protocols, the disclosure is not limited to such standards and protocols. For example, standards for power over ethernet represent an example of the state of the art. Such standards are periodically superseded by faster or more efficient equivalents having essentially the same functions. Accordingly, replacement standards and protocols having the same or similar functions are considered equivalents thereof.

As set forth herein, a visually identifiable cable is provided according to an aspect of the present disclosure. The visually identifiable cable includes an electrically illuminable outer sheathing. The visually identifiable cable also includes at least one internal tangible transmission interface medium internally disposed in the electrically illuminable outer sheathing.

The electrically illuminable outer sheathing is selectively illuminated by application of electricity to the electrically illuminable outer sheathing, according to another aspect of the present disclosure.

The electrically illuminable outer sheathing is continuously illuminated when electricity is applied to the electrically illuminable outer sheathing, according to still another aspect of the present disclosure.

The electrically illuminable outer sheathing is intermittently illuminated when electricity is applied to the electrically illuminable outer sheathing, according to yet another aspect of the present disclosure.

The electrically illuminable outer sheathing is supplied with current via an electroluminescent inverter device to which the electrically illuminable outer sheathing is connected, according to another aspect of the present disclosure.

The electrically illuminable outer sheathing illuminates in a color distinguishable from a color in which another visually identifiable cable, supplied with current via the electroluminescent inverter device, illuminates, according to still another aspect of the present disclosure.

The color in which the electrically illuminable outer sheathing illuminates corresponds to a material used in an outermost layer of the electrically illuminable outer sheathing, according to yet another aspect of the present disclosure.

The electrically illuminable outer sheathing illuminates in a color distinguishable from colors in which a plurality of other visually identifiable cables, supplied with current via the electroluminescent inverter device, illuminate, according to another aspect of the present disclosure. Each of the electrically illuminable outer sheathing and the other visually identifiable cables illuminate in a color different from any other of the electrically illuminable outer sheathing and the other visually identifiable cables, according to still another aspect of the present disclosure.

The electrically illuminable outer sheathing illuminates in a pattern distinguishable from an illumination pattern in which another visually identifiable cable, supplied with current via the electroluminescent inverter device, illuminates, according to yet another aspect of the present disclosure.

The electrically illuminable outer sheathing comprises electro-luminescent (EL) wire, according to another aspect of the present disclosure.

The at least one internal tangible transmission interface medium complies with the institute of electronics and electrical engineers standard 802.3af for power over ethernet (PoE), according to still another aspect of the present disclosure.

The internal tangible transmission interface medium is powered by power over ethernet of approximately 48 Volts DC at currents up to approximately 400 milli-amperes, according to yet another aspect of the present disclosure.

An inverter converts the DC voltage provided by power over ethernet into AC power required by the electrically illuminable outer sheathing, according to another aspect of the present disclosure.

The inverter comprises an electroluminescent inverter connected by the electrically illuminable outer sheathing between a power over ethernet power source device and a power over ethernet powered device, according to still another aspect of the present disclosure.

The power over ethernet power source device provides power to the power over ethernet powered device directly over the tangible transmission interface medium, according to yet another aspect of the present disclosure.

The power over ethernet powered device provides DC power to the electroluminescent inverter, according to another aspect of the present disclosure. The electroluminescent inverter converts the DC power to AC power, according to still another aspect of the present disclosure. The electroluminescent inverter provides the converted AC power as the AC power required by the electroluminescent outer sheathing, according to yet another aspect of the present disclosure.

The power over ethernet power source device controls application of power to a plurality of power over ethernet powered devices on an individual basis, according to another aspect of the present disclosure.

The DC voltage provided to the inverter is transformed from the power over ethernet, and power provided to the inverter and not required by the electrically illuminable outer sheathing is returned to the visually identifiable cable to power down-stream power over ethernet devices via a second power over ethernet source device, according to still another aspect of the present disclosure.

As also set forth herein, a visually identifiable cable includes at least one internal tangible transmission interface medium, according to an aspect of the present disclosure. The visually identifiable cable also includes an electrically illuminable outer sheathing externally wrapped around the internal tangible transmission interface medium, according to another aspect of the present disclosure.

As additionally set forth herein, a visually identifiable cable includes at least one tangible transmission interface medium, according to an aspect of the present disclosure. The visually identifiable cable also includes an electrically illuminable tangible medium physically affixed to the at least one tangible interface medium, according to another aspect of the present disclosure.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A visually identifiable cable, comprising:

an electrically illuminable outer sheathing; and an internal tangible transmission interface medium internally disposed in the electrically illuminable outer sheathing and used to transmit power to a device, wherein the electrically illuminable outer sheathing is outermost sheathing for the internal tangible transmission interface medium in the visually identifiable cable.

2. The visually identifiable cable of claim 1, wherein the electrically illuminable outer sheathing is selectively illuminated by application of electricity to the electrically illuminable outer sheathing.

3. The visually identifiable cable of claim 2, wherein the electrically illuminable outer sheathing is continuously illuminated when electricity is applied to the electrically illuminable outer sheathing.

4. The visually identifiable cable of claim 2, wherein the electrically illuminable outer sheathing is intermittently illuminated when electricity is applied to the electrically illuminable outer sheathing.

5. The visually identifiable cable of claim 1, wherein the electrically illuminable outer sheathing is supplied with current via an electroluminescent inverter device to which the electrically illuminable outer sheathing is connected.

6. The visually identifiable cable of claim 5, wherein the electrically illuminable outer sheathing illuminates in a color distinguishable from a color in which another visually identifiable cable, supplied with current via the electroluminescent inverter device, illuminates.

7. The visually identifiable cable of claim 6, wherein the color in which the electrically illuminable outer sheathing illuminates corresponds to a material used in an outermost layer of the electrically illuminable outer sheathing.

8. The visually identifiable cable of claim 5, wherein the electrically illuminable outer sheathing illuminates in a color distinguishable from colors in which a plurality of other visually identifiable cables, supplied with current via the electroluminescent inverter device, illuminate, and wherein each of the electrically illuminable outer sheathing and the other visually identifiable cables illuminate in a color different from any other of the electrically illuminable outer sheathing and the other visually identifiable cables.

9. The visually identifiable cable of claim 5, wherein the electrically illuminable outer sheathing illuminates in a pattern distinguishable from an illumination pattern in which another visually identifiable cable, supplied with current via the electroluminescent inverter device, illuminates.

10. The visually identifiable cable of claim 1, wherein the electrically illuminable outer sheathing comprises electro-luminescent (EL) wire.

11. The visually identifiable cable of claim 1, wherein the internal tangible transmission interface medium complies with the institute of electronics and electrical engineers standard 802.3af for power over ethernet (PoE).

12. The visually identifiable cable of claim 11, wherein the internal tangible transmission interface medium is powered by power over ethernet of approximately 48 Volts DC at currents up to approximately 400 milli-amperes.

13. The visually identifiable cable of claim 12, wherein an inverter converts the DC voltage provided by power over ethernet into AC power required by the electrically illuminable outer sheathing.

14. The visually identifiable cable of claim 13, wherein the device is a power over ethernet powered device, and wherein the inverter comprises an electroluminescent inverter connected by the electrically illuminable outer sheathing between a power over ethernet power source device and the power over ethernet powered device.

15. The visually identifiable cable of claim 14, wherein the power over ethernet power source device provides power to the power over ethernet powered device directly over the internal tangible transmission interface medium.

16. The visually identifiable cable of claim 15, wherein the power over ethernet powered device provides DC power to the electroluminescent inverter, wherein the electroluminescent inverter converts the DC power to AC power, and wherein the electroluminescent inverter provides the converted AC power as the AC power required by the electroluminescent outer sheathing.

17. The visually identifiable cable of claim 16, wherein the power over ethernet power source device controls application of power to a plurality of power over ethernet powered devices on an individual basis.

18. The visually identifiable cable of claim 14, wherein the DC voltage provided to the inverter is transformed from the power over ethernet, and power provided to the inverter and not required by the electrically illuminable outer sheathing is returned to the visually identifiable cable to power down-stream power over ethernet devices via a second power over ethernet source device.

* * * * *